US008379888B2

(12) United States Patent
Lee et al.

(10) Patent No.: US 8,379,888 B2
(45) Date of Patent: Feb. 19, 2013

(54) FLEXIBLE PIEZOELECTRIC SOUND-GENERATING DEVICES

(75) Inventors: Chih-Kung Lee, Taipey (TW); Wen-Ching Ko, Kaohsiung (TW); Jia-Lun Chen, Tainan (TW); Wen-Hsin Hsiao, Longtan Township (TW); Wen-Jong Wu, Taipei (TW)

(73) Assignee: National Taiwan University (TW)

( * ) Notice: Subject to any disclaimer, the term of this patent is extended or adjusted under 35 U.S.C. 154(b) by 1196 days.

(21) Appl. No.: 12/169,569

(22) Filed: Jul. 8, 2008

(65) Prior Publication Data

US 2009/0185701 A1 Jul. 23, 2009

(30) Foreign Application Priority Data

Jan. 18, 2008 (TW) ..... 97102002 A

(51) Int. Cl.
*H04R 25/00* (2006.01)
*H04R 3/00* (2006.01)

(52) U.S. Cl. ..... 381/190; 381/116

(58) Field of Classification Search ..... 381/190, 381/116

See application file for complete search history.

(56) References Cited

U.S. PATENT DOCUMENTS

| | | | | |
|---|---|---|---|---|
| 4,079,213 | A * | 3/1978 | Bage et al. | 381/163 |
| 4,515,997 | A * | 5/1985 | Stinger, Jr. | 381/116 |
| 4,558,249 | A | 12/1985 | Lerch et al. | |
| 4,638,207 | A | 1/1987 | Radice | |
| 6,091,182 | A | 7/2000 | Takeuchi et al. | |
| 6,327,760 | B1 | 12/2001 | Yun et al. | |
| 6,349,141 | B1 * | 2/2002 | Corsaro | 381/190 |
| 6,504,289 | B2 | 1/2003 | Toda et al. | |
| 6,584,660 | B1 | 7/2003 | Shimogawa et al. | |
| 6,606,389 | B1 | 8/2003 | Selfridge et al. | |
| 6,717,337 | B2 | 4/2004 | Howarth et al. | |
| 6,888,947 | B2 | 5/2005 | Takeshima et al. | |
| 6,894,425 | B1 | 5/2005 | Solomon et al. | |
| 6,924,584 | B2 | 8/2005 | Buhler et al. | |
| 6,937,736 | B2 | 8/2005 | Toda | |
| 6,967,431 | B2 | 11/2005 | Buhler et al. | |
| 7,038,356 | B2 | 5/2006 | Athanas | |
| 2008/0139946 | A1 | 6/2008 | Adachi et al. | |

FOREIGN PATENT DOCUMENTS

| | | |
|---|---|---|
| TW | 520573 | 2/2003 |
| TW | 200502194 | 1/2005 |

OTHER PUBLICATIONS

Office Action dated Nov. 1, 2012 from corresponding application No. TW 098101342.

* cited by examiner

*Primary Examiner* — Charles Garber
*Assistant Examiner* — Calvin Choi
(74) *Attorney, Agent, or Firm* — Lowe Hauptman Ham & Berner, LLP

(57) ABSTRACT

A sound-generating device comprises a first enclosure having at least one first electrode and a first piezoelectric layer, a first terminal of an audio signal output being coupled to the at least one first electrode of the first enclosure, a second enclosure having at least one first electrode and a first piezoelectric layer, and a first bendable element coupled between the first and second enclosures. The at least one first electrode is coupled with the first terminal of the audio signal output. The first piezoelectric layer of the first enclosure and the first piezoelectric layer of the second enclosure are configured to respond to the signal supplied by the audio signal output and to generate sound waves.

14 Claims, 4 Drawing Sheets

FLEXIBLE PIEZOELECTRIC SOUND-GENERATING DEVICES

BACKGROUND OF THE INVENTION

1. Field of the Invention

This invention relates to sound-generating devices, and more particularly, to flexible piezoelectric loudspeakers.

2. Background of the Invention

In the recent years, there have been continued developments for electronic products. One design concept has been providing lightweight, thin, portable and/or small devices. In this regard, flexible electronic technology has been increasingly used in various applications, such as thin-screen displays, LCDs, flexible circuits and flexible solar cells. Applications for flexible electronics, such as flexible speakers, may benefit from their low profile, reduced weight, and/or low manufacturing cost.

A loudspeaker may produce sound by converting electrical signals from an audio signal source into mechanical motions. Moving-coil speakers are widely used currently, which may produce sound from the back-and-forth motion of a cone that is attached to a coil of wire suspended in or movably coupled with a magnetic field. A current flowing through the coil may induce a varying magnetic field around the coil. The interaction of the two magnetic fields causes relative movements of the coil, thereby moving the cone back and forth. This compresses and decompresses the air, and thus generating sound waves. Due to structural limitations, moving-coil speakers are less likely to be made flexible or in a low profile.

Flexible piezoelectric loudspeakers, such as piezoelectric polyvinylidene fluoride speakers, may be made of flexible polymer materials. With electric polarization, the flexible polymer material may possess characteristics of permanent polarization and resistance to environmental conditions. Thus, such flexible polymers are suitable for being fabricated as loudspeakers.

U.S. Pat. No. 4,638,207 relates to a piezoelectric balloon speaker with a piezoelectric polymer film. The inflated balloon may provide tension for the piezoelectric polymer film. In addition, the resonance frequency may be adjustable by the pressure applied to the balloon. However, such a speaker may not be fabricated as a low-profile flexible loudspeaker. U.S. Pat. No. 6,504,289 relates to a piezoelectric transducer for transmitting acoustic energy. The transducer is enclosed in a rigid enclosure and thus cannot be made flexible. U.S. Pat. No. 6,349,141 relates to a flexible audio transducer with a balloon structure. The balloon structure may result in some issues on structure strength and designs relating to resonance frequency. U.S. Pat. No. 6,717,337 relates to an acoustic actuator with a piezoelectric drive element made of piezoelectric ceramics in the lead zirconate titanate (PZT) or PZT derivatives. In response to the radial contraction and expansion of the piezoelectric drive element, an acoustic diaphragm may vibrate to generate sound waves. The piezoelectric ceramics however are vulnerable and susceptible to fragmentation.

BRIEF SUMMARY OF THE INVENTION

One example consistent with the invention provides a sound-generating device comprising a first enclosure having at least one first electrode and a first piezoelectric layer, a first terminal of an audio signal output being coupled to the at least one first electrode of the first enclosure, a second enclosure having at least one first electrode and a first piezoelectric layer, and a first bendable element coupled between the first and second enclosures. The at least one first electrode is coupled with the first terminal of the audio signal output. The first piezoelectric layer of the first enclosure and the first piezoelectric layer of the second enclosure are configured to respond to the signal supplied by the audio signal output and to generate sound wave.

In another example consistent with the invention, a flexible piezoelectric loudspeaker comprises at least two enclosures with at least one bendable element coupled between two neighboring enclosures and a thin film comprising at least one electrode and at least one piezoelectric layer. The enclosures have a flexible layer with flexural rigidity as part of the enclosures. The at least one electrode is coupled with a terminal of an audio signal output. The at least one piezoelectric layer is configured to respond to a signal supplied by a signal input and to generate sound waves.

It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The foregoing summary, as well as the following detailed description of the invention, will be better understood when read in conjunction with the appended, exemplary drawings. It should be understood, however, that the invention is not limited to the precise arrangements and instrumentalities shown.

In the drawings.

DETAILED DESCRIPTION OF THE INVENTION

Figure 1:
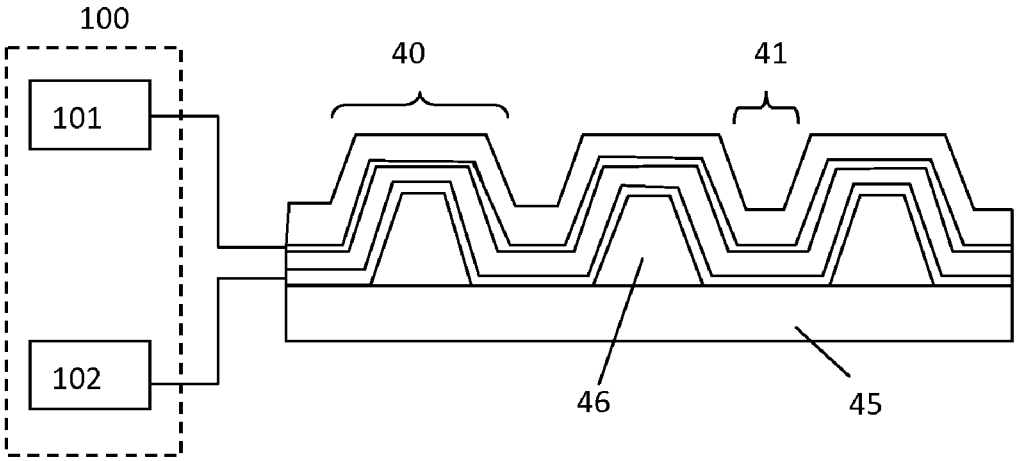
FIG. 1 is a sectional view of an exemplary flexible piezoelectric loudspeaker in examples consistent with the present invention.

FIG. 1 illustrates an exemplary flexible piezoelectric loudspeaker in examples consistent with the present invention. The flexible piezoelectric loudspeaker of FIG. 1 may include a number of enclosures 40, a number of bendable elements 41, a substrate 45 and a driving circuit 100 with two terminals 101 and 102.

Figure 2:
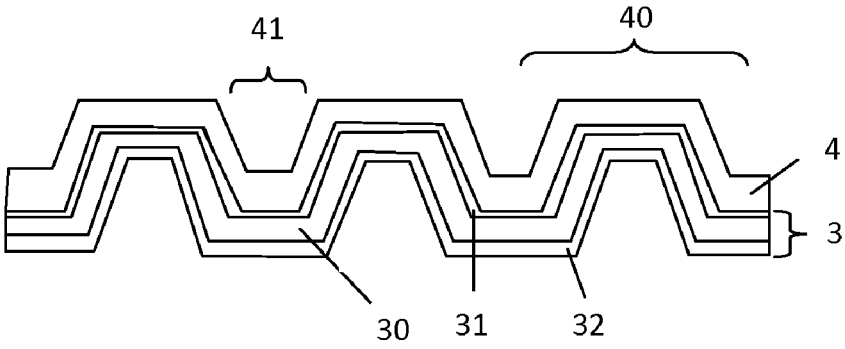
FIG. 2 is a detailed sectional view of portions of an exemplary flexible piezoelectric loudspeaker in examples consistent with the present invention.

FIG. 2 shows details of the enclosures 40 and the bendable elements 41. The enclosures 40 and bendable elements 41 may be fabricated by pressing, thermal pressing, vacuum compression, injection molding or a roll-to-roll process. The enclosures 40 may be in a circular, rectangular, or polygonal shape. As shown in FIG. 1, the enclosures 40 and the substrate 45 may provide a cavity 46. The rigidity of the enclosures 40 may be substantially hard to form the enclosures. The bendable elements 41 with flexural rigidity may be provided over the substrate 45 as shown in FIG. 1.

The enclosures 40 and the bendable elements 41 may comprise a flexible layer 4 and a piezoelectric structure 3. The flexible layer 4 may be provided over the piezoelectric structure 3 by a process, such as ultrasound pressing, thermal pressing, mechanical press, gluing or a roll-to-roll pressing process. The flexible layer 4 may be a transparent material. The flexible layer 4 may be made of plastic materials with plasticity, blended fibers or thin metal plates. The thickness of the flexible layer 4 may be in a range of 10 micrometers and 10000 micrometers. The flexible layer 4 may provide different thicknesses for the bendable element 41 and the enclosures 40. The flexible layer 4 may be formed by a process, such as thermal molding, injection molding, pressing or a roll-to-roll molding process. The piezoelectric structure 3 may include a first electrode 31, a second electrode 32 and a piezoelectric layer 30 sandwiched between the first and second electrodes 31 and 32. The piezoelectric layer 30 may be a transparent material. The piezoelectric layer 30 may be made of materials in polyvinylidene difluoride (PVDF) or PVDF derivatives. In one example, the piezoelectric layer 30 may be made of poly (vinylidene fluoride-trifluoroethylene) (P(VDF-TrFE)) or poly(vinylidene fluoride/tetrafluoroetbylene) (P(VDF-TeFE)). In another example, the piezoelectric layer 30 may be made of a blend of a material in PVDF or PVDF derivatives and at least one of lead zirconate titanate (PZT) fibers or particles, polymethylmethacrylate (PMMA), or poly(vinyl chloride) (PVC). These materials may be first processed by spray molding, injection molding, a roll-to-roll pressing process or thermal molding to form a processed material. A piezoelectric layer 30 may be formed by uniaxial tensile and corona discharge on the processed material. The thickness of the piezoelectric layer 30 may be in a range of 0.1 micrometers to 3000 micrometers. The electrodes 31 and 32 may be a transparent material. The electrodes 31 and 32 made of gold, silver, aluminum, copper, chromium, platinum, indium tin oxide, silver gel, copper gel or other conductive materials, may be coated on both surfaces of the piezoelectric layer 30 by sputtering, evaporation, spin-coating or screen-printing. The thickness of the electrode 31 and 32 may be in a range of 0.01 micrometers to 100 micrometers.

Figure 5:
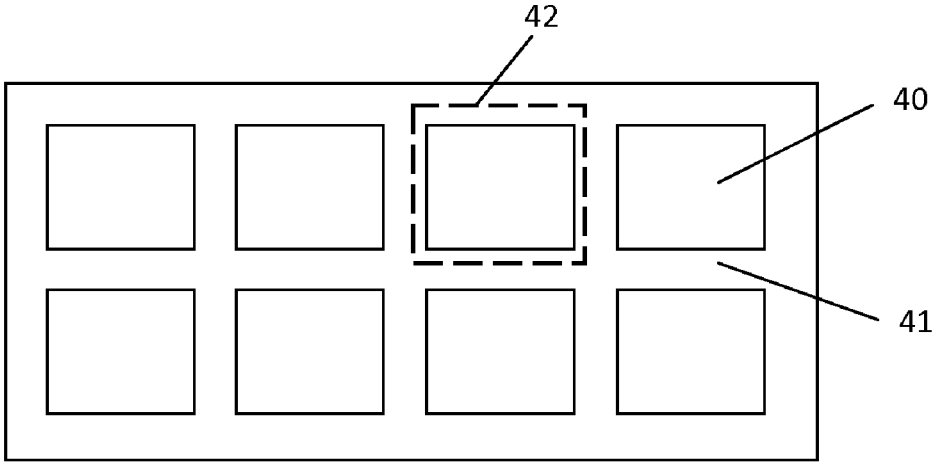
FIG. 5 is a top view of an exemplary application of an exemplary flexible piezoelectric loudspeaker in examples consistent with the present invention.

With respect to fabrication of a flexible piezoelectric loudspeaker, the enclosures 40 are provided over the substrate 45 by a roll-to-roll pressing process or a vertical pressing process so that the bendable elements 41 may be in contact with the substrate 45. In one example, the bendable elements 41 may be affixed to the substrate 45 by thermal pressing, ultrasound pressing, or mechanical press. Alternatively, the bendable elements 41 may be affixed to the substrate 45 by an adhesive element, such as a double-sided adhesive tape, epoxy resin or instant adhesive glues. The first enclosures 40 and the bendable elements 41 on the substrate 45 may constitute one unit 42 (shown in FIG. 5) of a flexible piezoelectric loudspeaker. A number of these units arranged together may constitute a flexible piezoelectric loudspeaker as shown in FIG. 5.

In operation of a flexible piezoelectric loudspeaker of FIG. 1, the terminal 101 of the driving circuit 100 may output an audio signal to the first electrode 31. The second terminal 102 may be connected to ground and the second electrode 32. According to the piezoelectric constitutive equation, $S_p = s_{pq}^{E} T_q + d_{pj} E_j$, where $$d_{pj} = \begin{bmatrix} 0 & 0 & 0 & 0 & d_{18}^{+} & 0 \\ 0 & 0 & 0 & d_{24}^{+} & 0 & 0 \\ d_{31}^{+} & d_{32}^{+} & d_{33}^{-} & 0 & 0 & 0 \end{bmatrix} \text{ and } E_j = \begin{bmatrix} 0 \\ 0 \\ E_3^{-} \end{bmatrix}$$

According to the equation, when a voltage is applied to the electrodes, it changes thickness and length of the piezoelectric layer. The change of its thickness may be very small but the change in its length may be significant. These changes may cause contraction and expansion of the piezoelectric layer. As such, the air is compressed and decompressed to generate sound waves.

Figure 3:
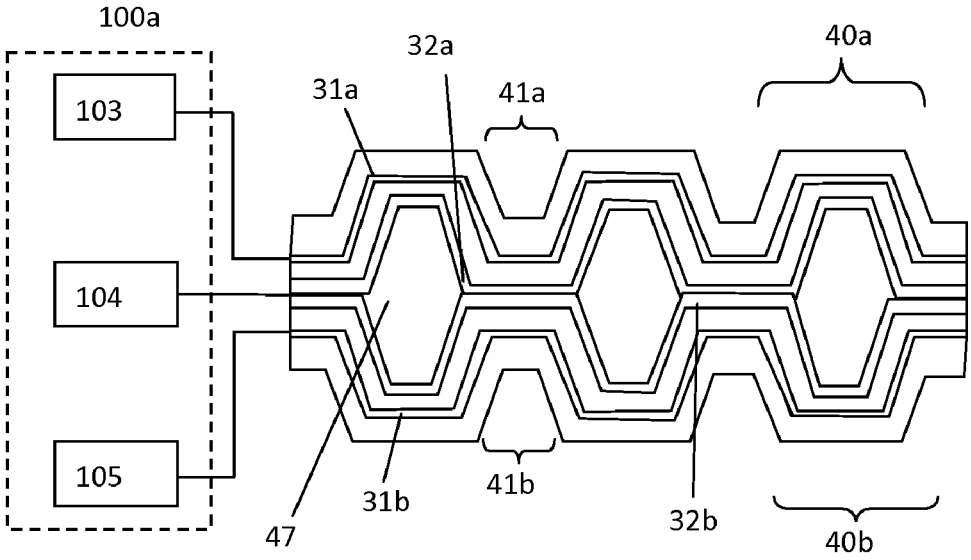
FIG. 3 is a sectional view of an exemplary flexible piezoelectric loudspeaker in examples consistent with the present invention.

FIG. 3 illustrates an exemplary flexible piezoelectric loudspeaker in examples consistent with the present invention. In this example, the flexible piezoelectric loudspeaker may include a number of first enclosures 40*a*, first bendable elements 41*a*, second enclosures 40*b*, and second bendable elements 41*b*. These elements may have the same structure as the enclosures 40 and the bendable elements 41 described above in connection with FIGS. 1 and 2, and thus, these elements and their detailed structure will not be repeated here.

The enclosures 40*a* and 40*b*, and the bendable elements 41*a* and 41*b* may provide a cavity 47 shown in FIG. 3. The first enclosures 40*a* may be provided over the second enclosures 40*b* by a roll-to-roll pressing process or a vertical pressing process. The first bendable elements 41*a* may be affixed to the second bendable elements 41*b* by, for example, thermal pressing, ultrasound pressing, or mechanical press. Alternatively, the first bendable elements 41*a* may be affixed to the second bendable elements 41*b* by an adhesive element such as a double-sided adhesive tape, epoxy resin or instant adhesive glues.

The driving circuit 100*a* may have a first terminal 103, a second terminal 104 and a third terminal 105. In operation of a flexible piezoelectric loudspeaker of FIG. 3, the terminal 103 may output a signal to the first electrode 31*a* of the first enclosures 40*a*. The terminal 105 may output a signal having the same phase as the signal from the terminal 103 to the first electrode 31*b* of the second enclosures 40*b*. The terminal 104 may connected to ground, the second electrode 32*a* of the first enclosures 40*a* and the second electrode 32*b* of the second enclosures 40*b*. According to the piezoelectric constitutive equation above, when a voltage is applied to the electrodes, it changes thickness and length of the piezoelectric layer. The change of its thickness may be very small but the change in its length may be significant. These changes may cause contraction and expansion of the piezoelectric layer. As such, the air is compressed and decompressed to generate sound waves.

Figure 4:
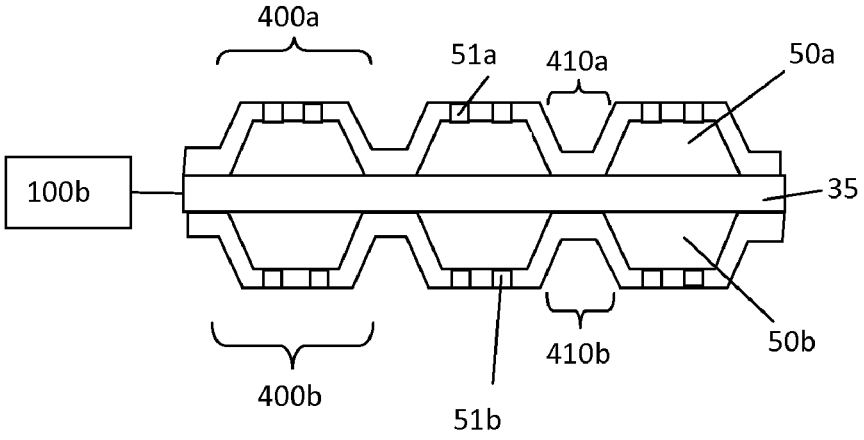
FIG. 4 is a sectional view of an exemplary flexible piezoelectric loudspeaker in examples consistent with the present invention.

FIG. 4 illustrates a piezoelectric loudspeaker in examples consistent with the present invention. The piezoelectric loudspeakers may include a number of first enclosures 400*a*, first bendable elements 410*a*, second enclosures 400*b* and second bendable elements 410*b*, a piezoelectric diaphragm 35 and a driving circuit 100*b*. The first enclosures 400*a*, the second enclosures 410*a* and the piezoelectric diaphragm 35 may provide cavities 50*a* and 50*b*.

The first and second enclosures 400*a* and 400*b* and the first and second bendable elements 410*a* and 410*b* may be made of plastic materials with plasticity, blended fibers or thin metal plates. They may be formed by a process, such as thermal molding, injection molding, vacuum molding, pressing or a roll-to-roll molding process. The first enclosures 400*a* may comprise a number of openings, such as acoustic holes 51*a*. The second enclosures 400*b* may comprise a number of acoustic holes 51*b*. The first and second enclosures 400*a* and

400*b* may be in a circular, rectangular, polygonal shape. The rigidity of the first and second enclosures 400*a* and 400*b* may be substantial hard to form the enclosures. The first and second bendable elements 410*a* and 410*b* with flexural rigidity may be provided over each side of the piezoelectric diaphragm 35.

Figure 7:
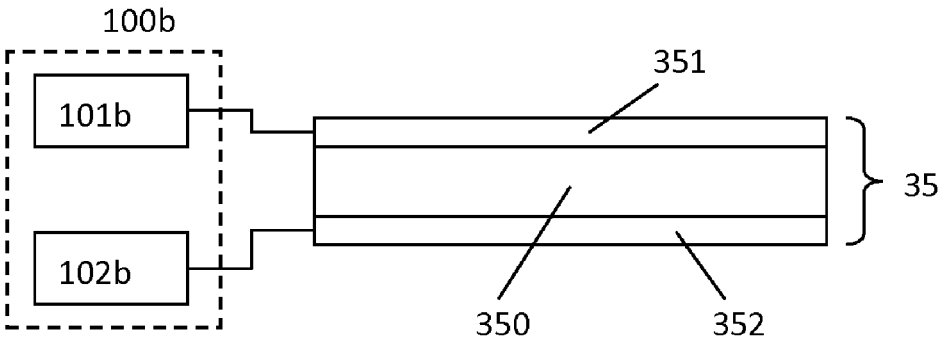
FIG. 7 is a sectional view of an exemplary piezoelectric diaphragm in examples consistent with the present invention.

FIG. 7 shows a piezoelectric diaphragm 35 in examples consistent with the present invention. The piezoelectric diaphragm 35 may comprise a first electrode 351, a second electrode 352 and a piezoelectric layer 350 placed between the first and second electrodes 351 and 352. The piezoelectric layer 350 may be made of materials in polyvinylidene difluoride (PVDF) or PVDF derivatives. In one example, the piezoelectric layer 350 may be made of P(VDF-TrFE) or P(VDF-TeFE). In another example, the piezoelectric layer 350 may be made of a blend of a material in PVDF or PVDF derivatives and at least one of lead zirconate titanate (PZT) fiber or particles, polymethylmethacrylate (PMMA), or poly(vinyl chloride (PVC). These materials may be first processed by spray molding, injection molding, a roll-to-roll pressing process or thermal molding to form a processed material. A piezoelectric layer 350 may be formed by uniaxial tensile and corona discharge on the processed material. The electrodes 351 and 352 made of gold, silver, aluminum, copper, chromium, platinum, indium tin oxide, silver gel, copper gel or other conductive materials, may be coated on both surfaces of the piezoelectric layer 350 by sputtering, evaporation, spin-coating or screen-printing.

Figure 6:
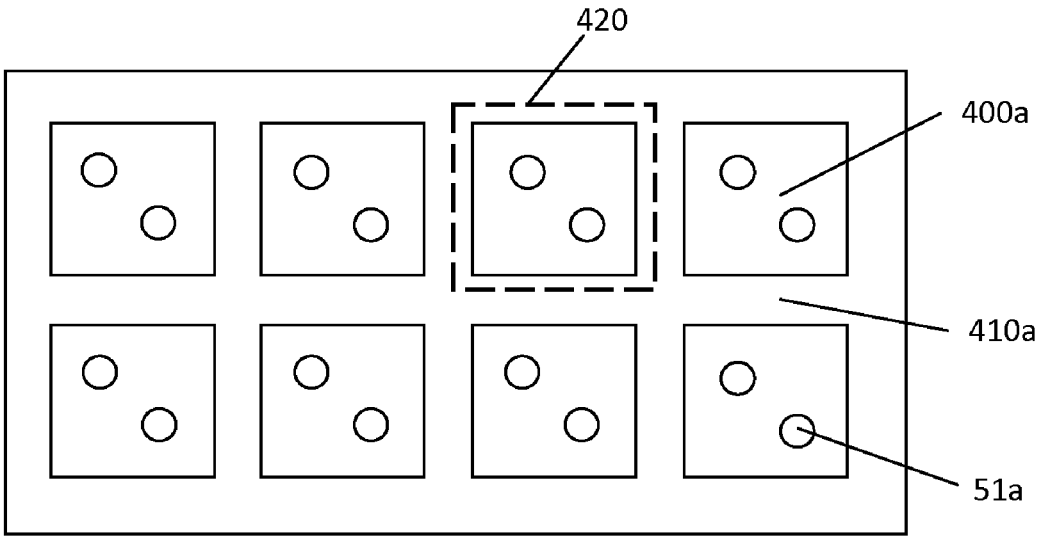
FIG. 6 is a top view of an exemplary application of an exemplary flexible piezoelectric loudspeaker in examples consistent with the present invention.

With respect to fabrication of a flexible piezoelectric loudspeaker of FIG. 4, the piezoelectric diaphragm 35 may be provided between first enclosures 400*a* and the second enclosures 400*b* by a roll-to-roll pressing process or a vertical pressing process. In one example, the bendable elements 410*a* and 410*b* may be affixed to the diaphragm 35 by thermal pressing, ultrasound pressing, and mechanical pressing. Alternatively, the bendable elements 410*a* and 410*b* may be affixed to the diaphragm 35 by an adhesive element, such as a double-sided adhesive tape, epoxy resin or instant adhesive glues. The assembly of the enclosures 400*a* and 400*b*, the bendable elements 410*a* and 410*b*, and the diaphragm 35 may constitute one unit 420 (shown in FIG. 6) of a flexible piezoelectric loudspeaker. A number of these units arranged together may constitute a flexible piezoelectric loudspeaker as shown in FIG. 6.

The driver circuit 100*b* may include a first terminal 101*b* and a second terminal 102*b*. In operation of a flexible piezoelectric loudspeaker of FIG. 4, the terminal 101*b* of the driving circuit 100*b* may output an audio signal to the first electrode 351. The terminal 102*b* may be connected to ground and the second electrode 352. According to the piezoelectric constitutive equation, when a voltage is applied to the electrodes, it may cause the piezoelectric diaphragm 35 to vibrate, thus generating sound waves. In addition, the cavities 50*a* and 50*b* may be designed in accordance with the Helmholtz equation to adjust the resonance frequency and increase the efficient of the loudspeaker.

Figure 8:
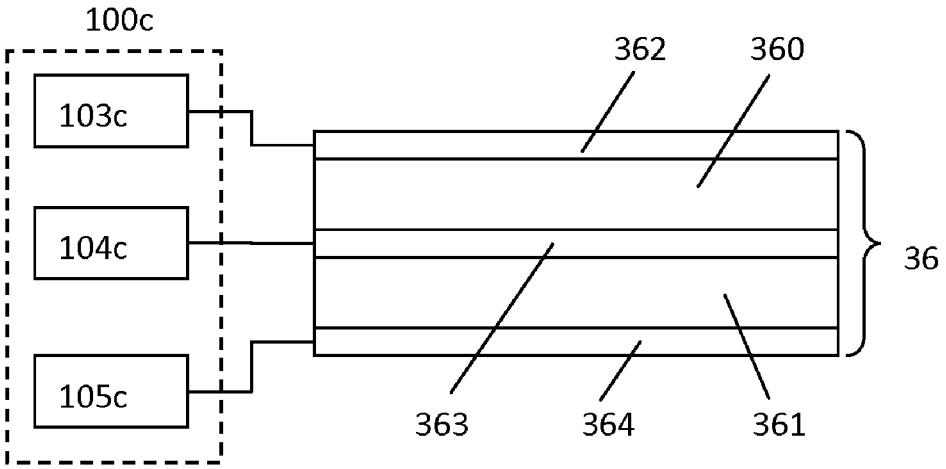
FIG. 8 is a sectional view of an exemplary piezoelectric diaphragm in examples consistent with the present invention.

FIG. 8 shows an exemplary piezoelectric diaphragm 36 in examples consistent with the present invention. The piezoelectric diaphragm 36 may have a bimorph structure. In one example, the diaphragm 36 may include a first electrode 362, a second electrode 363, a third electrode 364, a first piezoelectric layer 360 and a second piezoelectric layer 361. The polarization directions of the two piezoelectric layers 360 and 361 may be opposite to each other. An exemplary flexible piezoelectric loudspeaker may be made in the same way as the one of FIG. 4 with a piezoelectric diaphragm 36 replacing the diaphragm 35 of FIG. 4. A flexible piezoelectric loudspeaker with a diaphragm in a bimorph structure may include a driving circuit 100*c* with three terminals 103*c*, 104*c* and 105*c*. In operation, the terminal 103*c* may output a signal to the first electrode 362. The terminal 105*c* may output a signal having the same phase as the signal from the terminal 103*c* to the third electrode 364. The terminal 104*c* may be connected to ground and the second electrode 363. According to the piezoelectric constitutive equation above, a voltage applied to the electrodes may cause the diaphragm 36 to vibrate, and thus generating sound waves.

It will be appreciated by those skilled in the art that changes could be made to the examples described above without departing from the broad inventive concept thereof. It is understood, therefore, that this invention is not limited to the particular examples disclosed, but it is intended to cover modifications within the spirit and scope of the present invention as defined by the appended claims.

We claim:

1. A sound-generating device, comprising:

a first enclosure having at least one first electrode and a first piezoelectric layer;

a first terminal of an audio signal output being coupled to the at least one first electrode of the first enclosure;

a second enclosure having at least one first electrode and a first piezoelectric layer, the at least one first electrode being coupled with the first terminal of the audio signal output; and a first bendable element coupled between the first and second enclosures, wherein the first enclosure, the second enclosure and the first bendable element are joined together by its ends, one end to another forming into a wave-shaped continuous structure, wherein the first piezoelectric layer of the first enclosure and the first piezoelectric layer of the second enclosure are configured to respond to the signal supplied by the audio signal output and to generate sound waves, wherein one or more wall structures of the first and second enclosures are substantially rigid to limit spacing variation in an enclosed space, wherein the first and second enclosures providing rigidity by thicker thickness on inner standing wall structures of the first and second enclosures than a thickness of the first bendable element.

2. The sound-generating device of claim 1, wherein at least one of the first piezoelectric layer of the first enclosure and the first piezoelectric layer of the second enclosure comprises at least one of materials in polyvinylidene difluoride (PVDF), PVDF derivatives and a blend of a material in polyvinylidene difluoride derivatives and one of lead zirconate titanate (PZT) fibers, lead zirconate titanate (PZT) particles, polymethylmethacrylate (PMMA), and poly(vinyl chloride) (PVC).

3. The sound-generating device of claim 1, wherein at least one of the first piezoelectric layer of the first enclosure and the first piezoelectric layer of the second enclosure has a thickness between about 0.1 micrometers and 3,000 micrometers.

4. The sound-generating device of claim 1, wherein the first and second enclosures and the first bendable element comprise a first flexible layer including at least one of a plastic material, blended fibers, and thin metal plates, the first flexible layer providing thinner thicknesses for the first bendable element and thicker thicknesses for the wall structures in the first and second enclosures so as to provide the substantially rigidity in the first and second enclosures and flexibility in the first bendable element.

5. The sound-generating device of claim 4, wherein the first flexible layer has thickness between about 10 micrometers and 10,000 micrometers.

6. The sound-generating device of claim 1, wherein one of the at least one first electrode of the first enclosure and the at least one first electrode of the second enclosure is formed from at least one of gold, silver, aluminum, copper, chromium, platinum, indium tin oxide, silver gel, copper gel, and other conductive materials.

7. The sound-generating device of claim 1, wherein one of the at least one first electrode of the first enclosure and the at least one first electrode of the second enclosure has a thickness between about 0.01 micrometers and 100 micrometers.

8. The sound-generating device of claim 1, wherein for at least one of the first and second enclosures, the at least one first electrode is formed on the first piezoelectric layer by at least one of sputtering, electroplate, evaporation, spin-coating and a screen-printing process.

9. The sound-generating device of claim 1, wherein each of the first and second enclosures is attached to a substrate so that an enclosed space is provided between each enclosure and the substrate.

10. The sound-generating device of claim 1, further comprising:

a third enclosure having at least one first electrode and a first piezoelectric layer, the third enclosure and the first enclosure being coupled so that a common enclosed space is provided between the first and third enclosures, a second terminal of the audio signal output being coupled to the at least one first electrode of the third enclosure;

a fourth enclosure having at least one first electrode and a first piezoelectric layer, the first electrode being coupled with the second terminal of the audio signal output, the fourth enclosure and the second enclosure being coupled so that a common enclosed space is provided between the second and fourth enclosures; and a second bendable element coupled between the third and fourth enclosures, wherein the first piezoelectric layer of the third enclosure and the first piezoelectric layer of the fourth enclosure are configured to respond to a signal supplied by the audio signal output and to generate sound waves.

11. The sound-generating device of claim 10, wherein the first and third enclosures are coupled by having an adhesive layer between a portion of the first bendable element and a portion of the second bendable element.

12. The sound-generating device of claim 10, wherein the first and second enclosures are coupled with the third and fourth enclosures by at least one of ultrasound pressing, thermal pressing, vacuum thermal compression, mechanical press, and a roll-to-roll process.

13. The sound-generating device of claim 1, wherein at least one of the first and second enclosures has a shape similar to one of circular, rectangular and polygonal shapes.

14. The sound-generating device of claim 1, wherein the first enclosure has an acoustic hole.

* * * * *